United States Patent [19]

Häfele et al.

[11] Patent Number: 4,692,102

[45] Date of Patent: Sep. 8, 1987

[54] FUEL INJECTION PUMP FOR INTERNAL COMBUSTION ENGINES

[75] Inventors: Walter Häfele, Fellbach; Bernhard Schenk, Stuttgart, both of Fed. Rep. of Germany

[73] Assignee: Robert Bosch GmbH, Stuttgart, Fed. Rep. of Germany

[21] Appl. No.: 398,513

[22] Filed: Jul. 15, 1982

[30] Foreign Application Priority Data

Sep. 25, 1981 [DE] Fed. Rep. of Germany ..... 3138211

[51] Int. Cl.[4] ..... F04C 49/08

[52] U.S. Cl. ..... 417/296; 137/493.3; 137/539.5

[58] Field of Search ..... 417/296; 137/539.5, 137/493.3

[56] References Cited

U.S. PATENT DOCUMENTS

| | | | |
|---|---|---|---|
| 2,344,565 | 3/1944 | Scott et al. | 137/493.3 X |
| 2,384,011 | 9/1945 | Bremser | 417/494 |
| 3,195,465 | 7/1965 | Hug | 417/296 |
| 3,375,852 | 4/1968 | Milster | 137/493.3 |
| 3,949,781 | 4/1976 | Scalabrin | 137/532 |
| 4,178,959 | 12/1979 | Farris et al. | 137/493.3 |

FOREIGN PATENT DOCUMENTS

| | | | |
|---|---|---|---|
| 125170 | 6/1949 | Sweden | 137/493.3 |

*Primary Examiner*—Leonard E. Smith
*Attorney, Agent, or Firm*—Edwin E. Greigg

[57] ABSTRACT

A pressure valve is proposed herein which is built into the injection pump, its valve closing body being guided in a valve carrier, and arranged to open in the supply direction of the fuel, counter to the force of a restoring spring. A check valve is built into the pressure valve, its valve seat carrier being secured to the valve closing body and its movable valve closing member is arranged to open counter to the supply direction of the fuel via a spring supported on the base of the valve closing body. For axially securing the valve seat carrier on the valve closing body, the restoring spring simultaneously engages the valve seat carrier. As a result, the satisfactory functioning of the check valve is assured.

2 Claims, 1 Drawing Figure

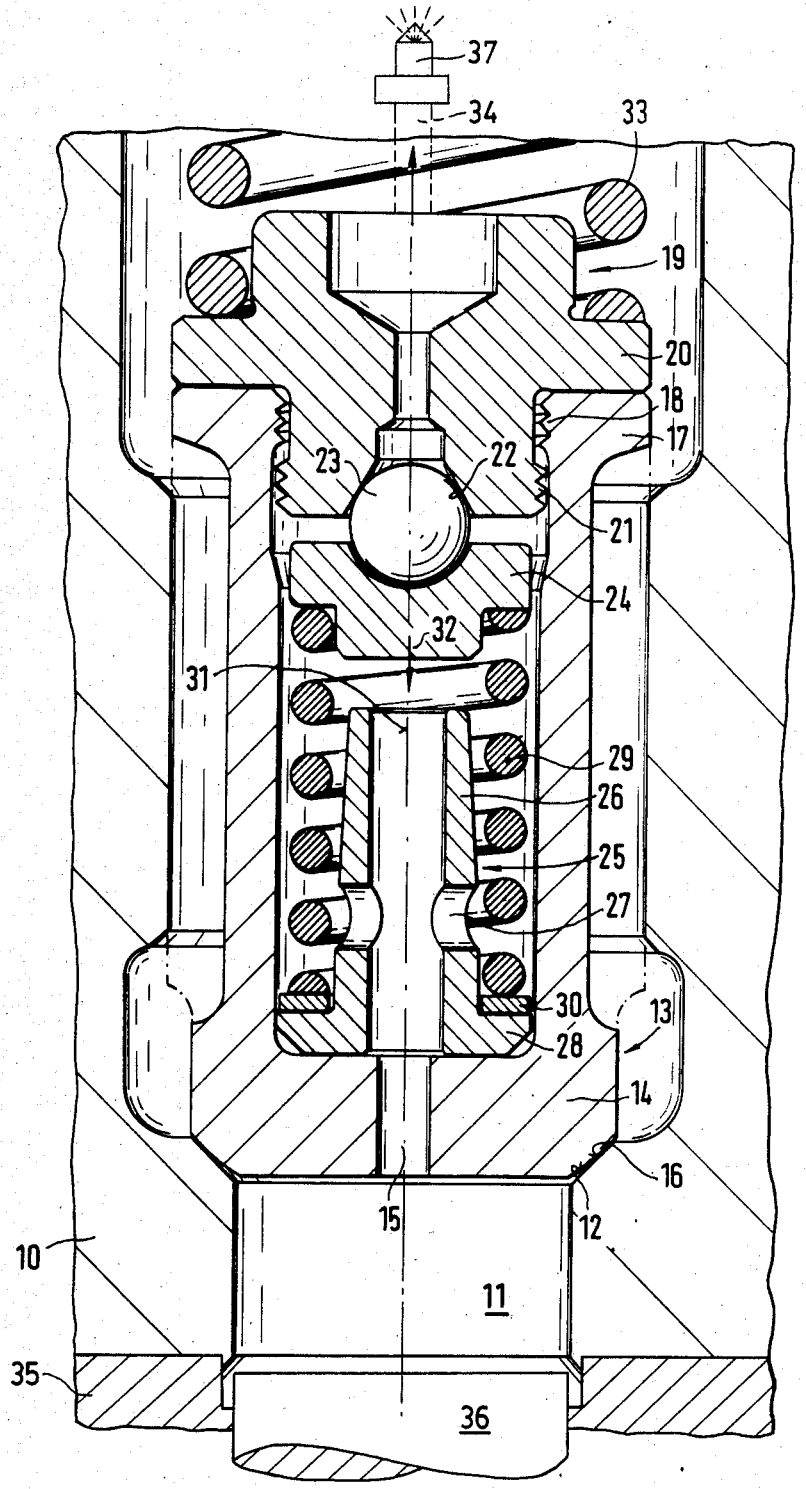
37
34
33
19
20
18
17
23
22
21
24
32
31
29
26
25
27
30
13
28
14
16
15
12
10
11
35
36

FUEL INJECTION PUMP FOR INTERNAL COMBUSTION ENGINES

BACKGROUND OF THE INVENTION

The invention is based on a fuel injection pump for internal combustion engines as revealed hereinafter. An injection pump of this type is known in which the parts of the check valve are secured in their operating position by a plug which is either screwed or pressed into place in the valve closing body. In so screwing or pressing such an element, however, the problem exists that the plug cannot with certainty be prevented from loosening, and the ability of the injection pump to function is impaired; it is particularly critical to prevent this from happening in such an important engine component as the fuel injection pump.

OBJECT AND SUMMARY OF THE INVENTION

With the fuel injection pump for internal combustion engines according to the invention, the problem in the prior art discussed above is solved without requiring additional parts. The concept on which the invention is based is to exploit the force of the restoring spring, which is always in effect, for the purpose of securing the valve carrier such that it cannot be shaken and loosened.

The invention will be better understood and further objects and advantages thereof will become more apparent from the ensuing detailed description of a preferred embodiment taken in conjunction with the drawing.

BRIEF DESCRIPTION OF THE DRAWING

The single FIGURE of the drawing is a detail of a diagonal cross section taken through a fuel injection pump according to the invention in the vicinity of an equal-pressure valve having a check valve inserted into it, shown larger than actual size.

DESCRIPTION OF THE PREFERRED EMBODIMENT

The single FIGURE of the drawing shows in detail form a valve carrier 10 of a pump housing 35 of a fuel injection pump for internal combustion engines. The valve carrier 10 encloses a work chamber 11 defined by a piston 36 and has a seat face 12. Supported on this end seat face 12 is a valve closing body 13 of a pressure valve acting as an equal-pressure valve, the valve closing body having a base 14 with a central bore 15 and another seat face 16 which cooperates with the seat face 12 of the valve carrier 10. The valve closing body 13 further has an outwardly projecting annular bulge 17 which is opposite the base 14 and has an upper inner thread 18.

Built into the valve closing body 13 is a check valve embodied as a ball valve, the valve seat carrier 19 of which has an outwardly protruding flange 20 arranged to rest on the annular bulge 17, an outer thread 21 cooperating with the inner thread 18 and a valve seat face 22. A movable valve closing member 23 embodied as a ball cooperates with this valve seat face 22 and includes a valve plate 24. A filler piece 25 has a sheath 26 with a perforation 27 and an outer collar 28. This outer collar is pressed by a helical spring 29 supported on the valve plate 24 against the base 14 of the valve closing body 13 via a punched disk 30. The axial height of the sheath 26, or in other words its longitudinal extent in the direction of the valve axis 31, limits the opening movement of the valve plate 24 in the direction of the arrow 32.

A restoring spring 33 embodied as a helical compression spring is supported in a manner not shown on the pump housing and presses the outer flange 20 of the valve seat carrier 29 continuously against the annular bulge 17 of the valve closing body 13.

The injection pump is illustrated in the drawing with the equal-pressure valve and the check valve closed. Upon the supply stroke, the fuel in the work chamber 11 which is to be injected presses the equal-pressure valve open, counter to the force of the restoring spring 33, and is delivered via the pressure line symbolized by the arrow 34 to an injection nozzle 37. At the end of injection, the abruptly falling pressure in the work chamber 11 effects the closing of the equal-pressure valve, and the remnant pressure remaining in the pressure line 34 opens the check valve, so that fuel flows back into the work chamber 11.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection pump for internal combustion engines having a piston defining a work chamber, said pump further including a pressure valve inserted into a pressure line which leads from a pump work chamber to an injection valve, said pressure valve having a valve closing body guided in a carrier and said pressure valve arranged to open in a supply direction of the fuel counter to the force of a restoring spring, said valve closing body provided with a check valve having a movable closing member and a valve seat carrier, said seat carrier of said check valve having an outer flange and provided with an outer first set of threads being secured on said valve closing body provided with an inner second set of threads, and the closing member of said check valve arranged to open counter to the supply direction of the fuel via a spring supported on a base of said valve closing body, characterized in that for the purpose of axially securing said valve seat carrier on said valve closing body, said restoring spring simultaneously engages said valve seat carrier and presses said outer flange of said valve seat carrier against said valve closing body, and further that both said sets of threads on said valve seat carrier and in said valve closing body cooperate only in a transit position, while in a functional position said first set of threads on said valve seat carrier are screwed all the way through said second set of threads in the valve closing body and are thus released from engagement with said first set of threads and juxtaposed therewith.

2. A fuel injection pump for internal combustion engines having a piston defining a work chamber, said pump including a pressure valve inserted into a pressure line which leads from a pump work chamber to an injection valve, said pressure valve having a valve closing body guided in a carrier and said pressure valve arranged to open in a supply direction of the fuel counter to the force of a restoring spring, said valve closing body provided with a check valve having a movable closing member and a valve seat carrier, said seat carrier of said check valve having an outer flange and provided with an outer first set of threads being secured on said valve closing body provided with an inner second set of threads, and the closing member of said check valve arranged to open counter to the supply direction of the fuel via a spring supported on a base of said valve closing body, characterized in that for the purpose of axially securing said valve seat carrier on said valve closing body, said restoring spring simultaneously engages said valve seat carrier and presses said outer flange of said valve seat carrier against said valve closing body, and further that both said sets of threads on said valve seat carrier and in said valve closing body cooperate only in a transit position, while in a functional position said first set of threads on said valve seat carrier are screwed all the way through said second set of threads in the valve closing body and are thus released from engagement with said first set of threads and juxtaposed therewith; and that said valve closing body encloses a filler piece having a sheath and an outer collar and further that said spring of said check valve presses said outer collar, via a punched disk, against said base of said valve closing body and further that said sheath has an axial length which limits the opening movement of said movable valve closing member of said check valve.

* * * * *